United States Patent [19]

Witte et al.

[11] 4,453,650

[45] Jun. 12, 1984

[54] CONTROL VALVE FOR AN AEROSOL CAN

[75] Inventors: Paul A. Witte, New Hope, Pa.; Michael J. Pappas, Caldwell, N.J.

[73] Assignee: Falcon Safety Products, Inc., Mountainside, N.J.

[21] Appl. No.: 320,750

[22] Filed: Nov. 12, 1981

[51] Int. Cl.[3] ..... B67D 5/22

[52] U.S. Cl. ..... 222/43; 222/402.14; 222/525; 239/573

[58] Field of Search ..... 222/3, 43, 48, 153, 222/402.16, 402.14, 402.15, 402.1, 394, 511, 518, 512, 522, 531, 532, 537, 526, 525, 559, 383, 321, 379, 474, 465, 469; 239/537, 541, 579, 573; 169/89, 30, 26; 251/114, 116, 111, 318, 319, 320–323, 353, 354, 349

[56] References Cited

U.S. PATENT DOCUMENTS

| | | | |
|---|---|---|---|
| Re. 22,045 | 3/1942 | Towart, Jr. | 221/73.5 |
| 597,292 | 1/1898 | Lindner et al. | 222/396 |
| 646,527 | 4/1900 | Linton | 222/402.15 |
| 1,751,314 | 3/1930 | Fountaine | 222/320 |
| 2,145,349 | 1/1939 | Haacke | 221/52 |
| 2,372,392 | 3/1945 | Pletman | 99/264 |
| 2,454,621 | 11/1948 | Allen | 222/400 |
| 2,530,583 | 11/1950 | Narkiewicz | 169/31 |
| 2,565,954 | 8/1951 | Dey | 222/394 |
| 2,586,575 | 2/1952 | Smyl | 169/31 |
| 2,598,308 | 5/1952 | Samuels et al. | 299/150 |
| 2,632,585 | 3/1953 | Tomasek | 222/394 |
| 2,783,080 | 2/1957 | Ringsby | 296/50 |
| 2,887,272 | 5/1959 | Rosenthal | 239/310 |
| 2,911,158 | 11/1959 | Doyle | 239/573 |
| 2,997,243 | 8/1961 | Kolb | 239/337 |
| 3,039,654 | 6/1962 | Lopatke et al. | 222/23 |
| 3,138,331 | 6/1964 | Kutik | 239/337 |
| 3,146,916 | 9/1964 | Kronheim | 222/182 |
| 3,189,232 | 6/1965 | Joffe | 222/394 |
| 3,209,949 | 10/1965 | Gartler | 222/49 |
| 3,235,127 | 2/1966 | Cline | 222/82 |
| 3,332,626 | 7/1967 | Meshberg | 239/579 |
| 3,422,996 | 1/1969 | Lipman | 222/402.11 |
| 3,503,539 | 3/1970 | O'Donnell | 222/402.1 |
| 3,608,791 | 9/1971 | Jordan | 222/402.11 |
| 3,780,694 | 12/1973 | Wilbur | 222/402.13 |
| 4,077,549 | 3/1978 | Beard | 222/321 |
| 4,157,774 | 6/1979 | Micallef | 222/321 |
| 4,197,915 | 4/1980 | Martin | 169/72 |
| 4,222,501 | 9/1980 | Hammett et al. | 222/207 |
| 4,241,853 | 12/1980 | Pauls et al. | 222/207 |
| 4,260,130 | 4/1981 | Brehm | 222/525 |

*Primary Examiner*—Joseph J. Rolla
*Assistant Examiner*—Kenneth Noland
*Attorney, Agent, or Firm*—Davis, Hoxie, Faithfull & Hapgood

[57] ABSTRACT

A fluid control valve including a housing with a chamber therein, a hollow barrel, an elongated trigger, a seal and spring. The chamber communicates with a source of fluid, and also has one end of the barrel, which is axially slideably mounted in the housing with the other end outside the housing. The barrel's normal position is furthest into said housing and, its activated position is axially outward therefrom. The trigger is substantially perpendicular to the barrel and is positioned on the barrel and engages the barrel adjacent to the housing with the barrel passing through an opening at one end of the trigger. The seal is movable in the chamber and normally closes one of the communication. The spring is in the chamber urging the seal and barrel into their normal position. Activation of the trigger engages the barrel, moving it axially against the spring permitting the seal to open the communication.

9 Claims, 8 Drawing Figures

FIG. 5
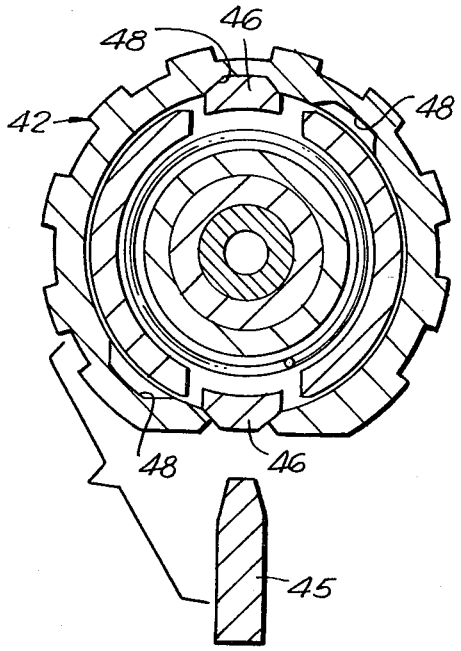
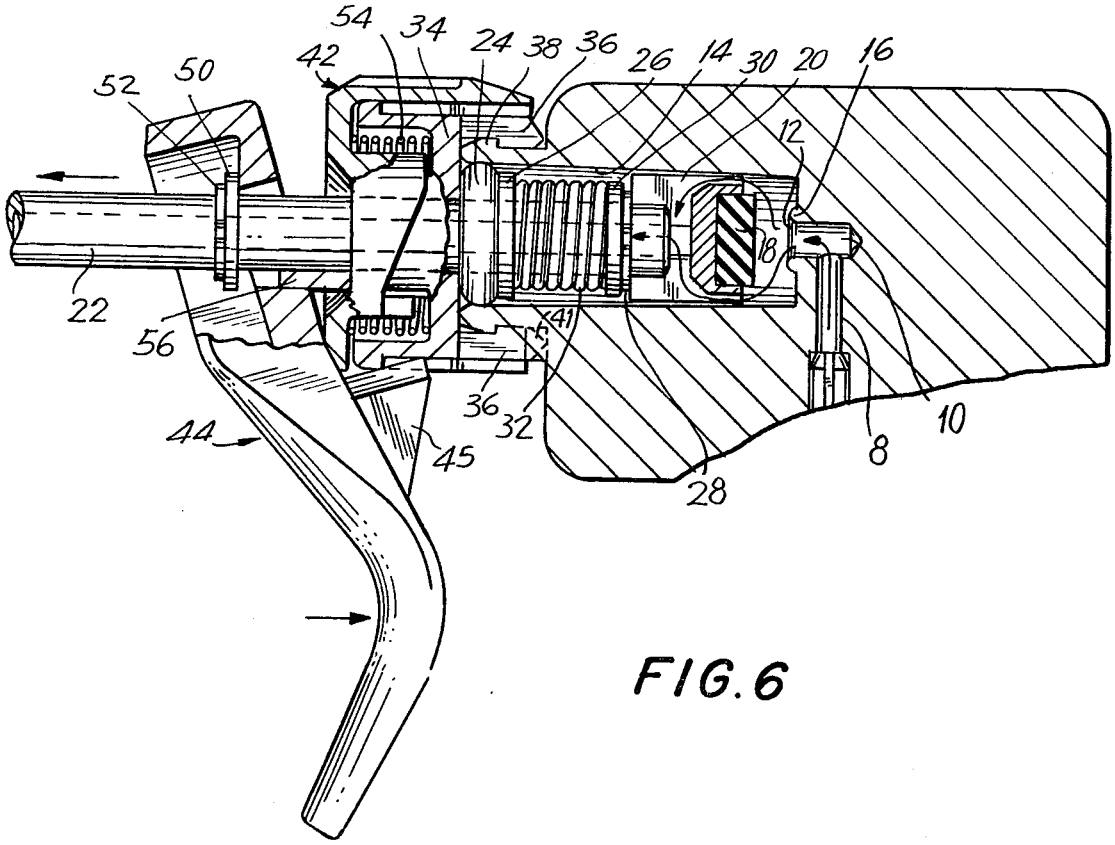
FIG. 6

FIG.7
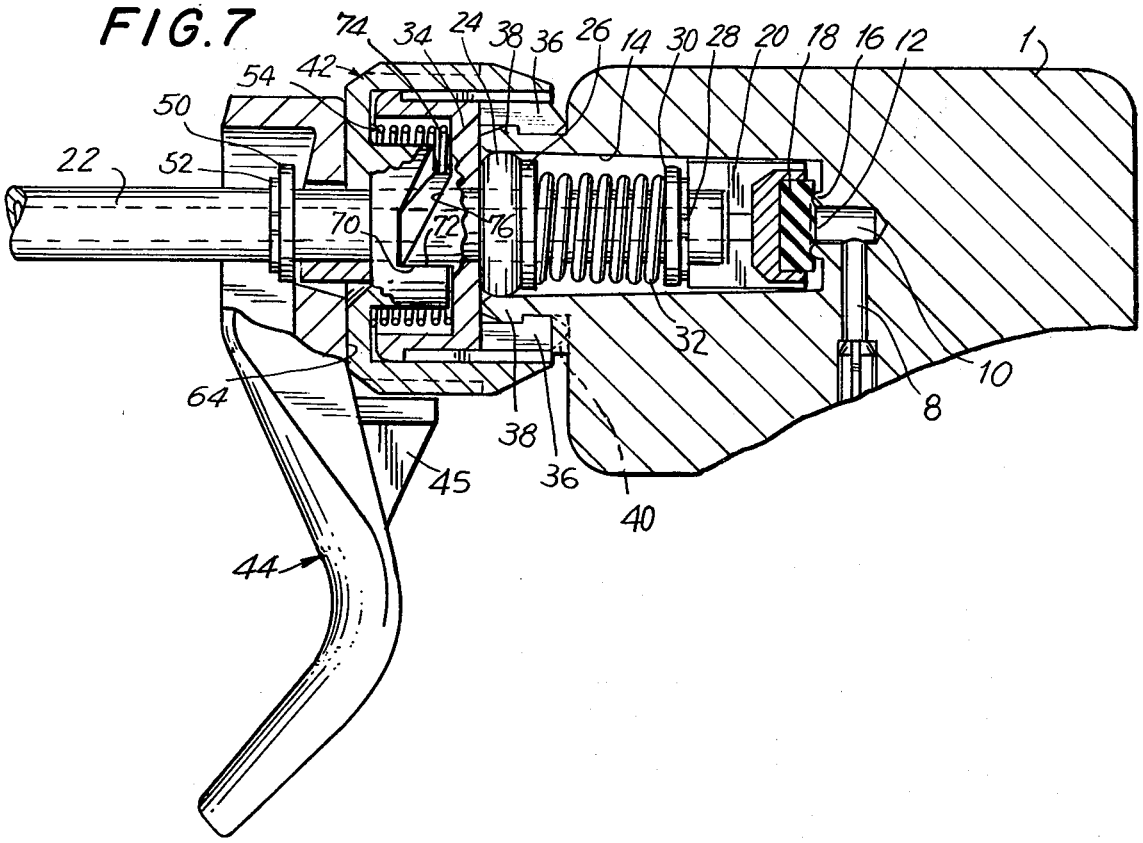
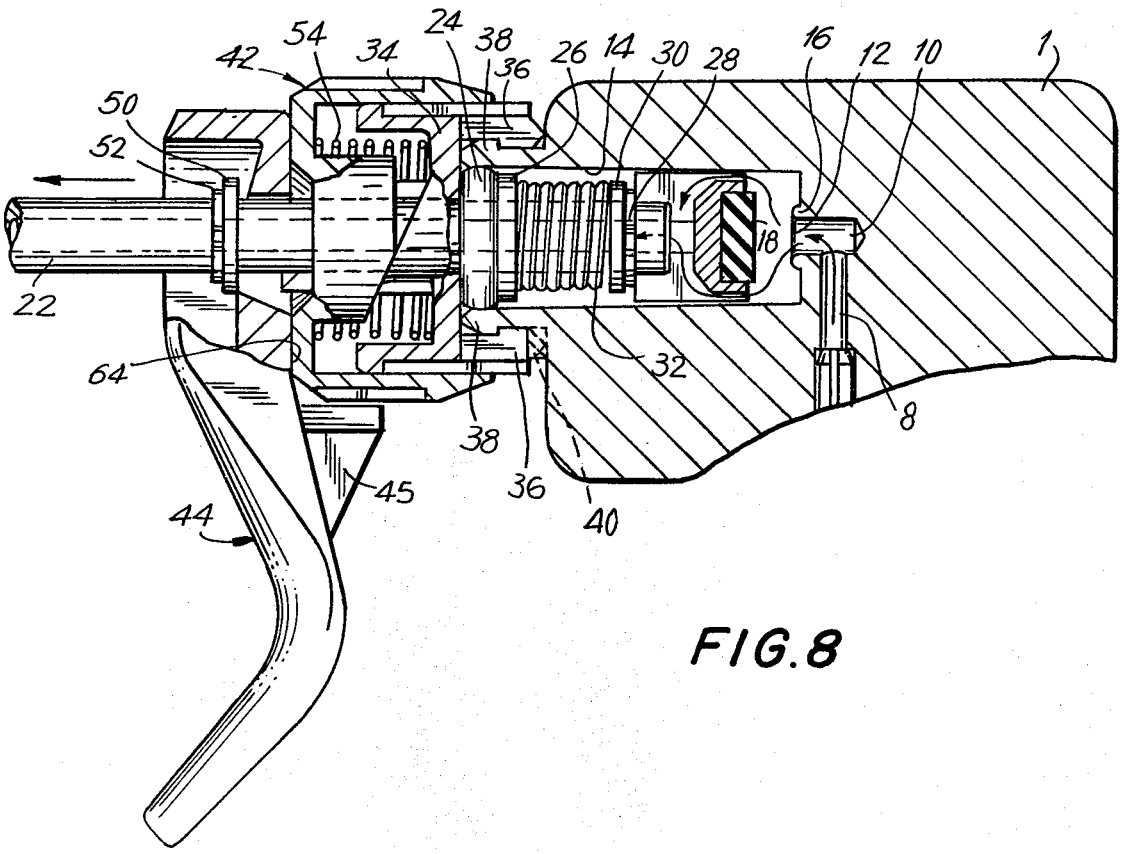
FIG.8

CONTROL VALVE FOR AN AEROSOL CAN

BACKGROUND OF THE INVENTION

The invention relates generally to fluid control valves, and particularly to control valves for aerosol cans.

The aerosol can with a push valve on top is a familiar industrial and household item. Various valves have been used on aerosol cans since aerosol first became available. There are various shortcomings to these valves, e.g. discomfort to the operator, especially in long use or where there is a large flow of gas and or with high pressure. If the operator's finger or hand is near the exit orifice, the cooling caused by the gas as it emerges may be a problem. Further, it is often difficult to accurately regulate the flow of gas, or to direct the flow to a particular area or region, especially when a blast of gas is needed, such as when an aerosol is to be used as a dusting medium to remove dust from a surface, or to clean a part (as previously done with compressed air) by the high velocity flow of gas. The control must be compatible with the aerosol can itself and the operator with the can and valve usually being held in one hand. The control valve mechanism must be rugged, reliable, and not requiring excessive (and preferably no) attention from the user.

It is also desireable that the valve be able to be lockable in an off position, so that it not be accidentally turned on, should it be knocked over, or leaned upon, or packed improperly. Additionally, it is desireable that the valve should be able to be locked on, i.e. to provide a continuous flow of gas without an operator having to hold a trigger mechanism.

The control valve of the invention has these and other features. It promises to function reliably, not leak or rattle, be economical to manufacture, require no maintenance; and where detachable, as is one embodiment of the present invention, be long lasting and durable, so that it may be used for a long period of time, being attached to successive fresh cans of aerosol.

SUMMARY OF THE INVENTION

According to an aspect of the invention, there is provided a detachable control valve for an aerosol can. The valve has a housing with a collar that is to be attached to the can and to actuate the aerosol can valve. A hollow barrel is axially slideably mounted on the housing with one end inside and the other end outside the housing. It has a normal position furthest into the housing and an activated position axially outward therefrom. A chamber in the housing communicates with the collar for receiving gas or other fluid from the aerosol can. An elongated trigger has an opening at one end and extends substantially perpendicular to the barrel. The trigger is positioned on the barrel between a first engaging member on the barrel and the housing with the barrel passing through the opening. The opening is slightly larger than the outside of the barrel to permit pivoting of the handle against the adjacent control knob. A movable seal in the chamber normally closes one end of the communication with the collar; while a spring in the chamber urges the seal and barrel into their normal position. Thus when the trigger is activated by an operator moving its other end, the trigger pivots against the adjacent control knob with its one end engaging the barrel member, axially moving the barrel outward from its normal position, against the force of the spring, and thus opening the seal and establishing a path for gas or other fluid from the aerosol can to flow to the chamber and then through the hollow in the barrel and out through the outer end of the barrel.

BRIEF DESCRIPTION OF THE DRAWING

FIG. 5 is an enlarged cross-sectional view, taken through V—V of FIG. 1.

FIG. 6 is a schematic side view (not to scale) illustrating the valve in the "ON" position, and with the trigger activated.

FIG. 7 is a schematic side view, similar to FIG. 6, but showing the valve in the "LOCK OFF" position.

FIG. 8 is a schematic side view, similar to the previous two FIGS., but showing the valve in the "LOCK ON" position.

Like elements in the different FIGS. bear like legend.

DESCRIPTION OF THE PREFERRED EMBODIMENT

Figure 1:
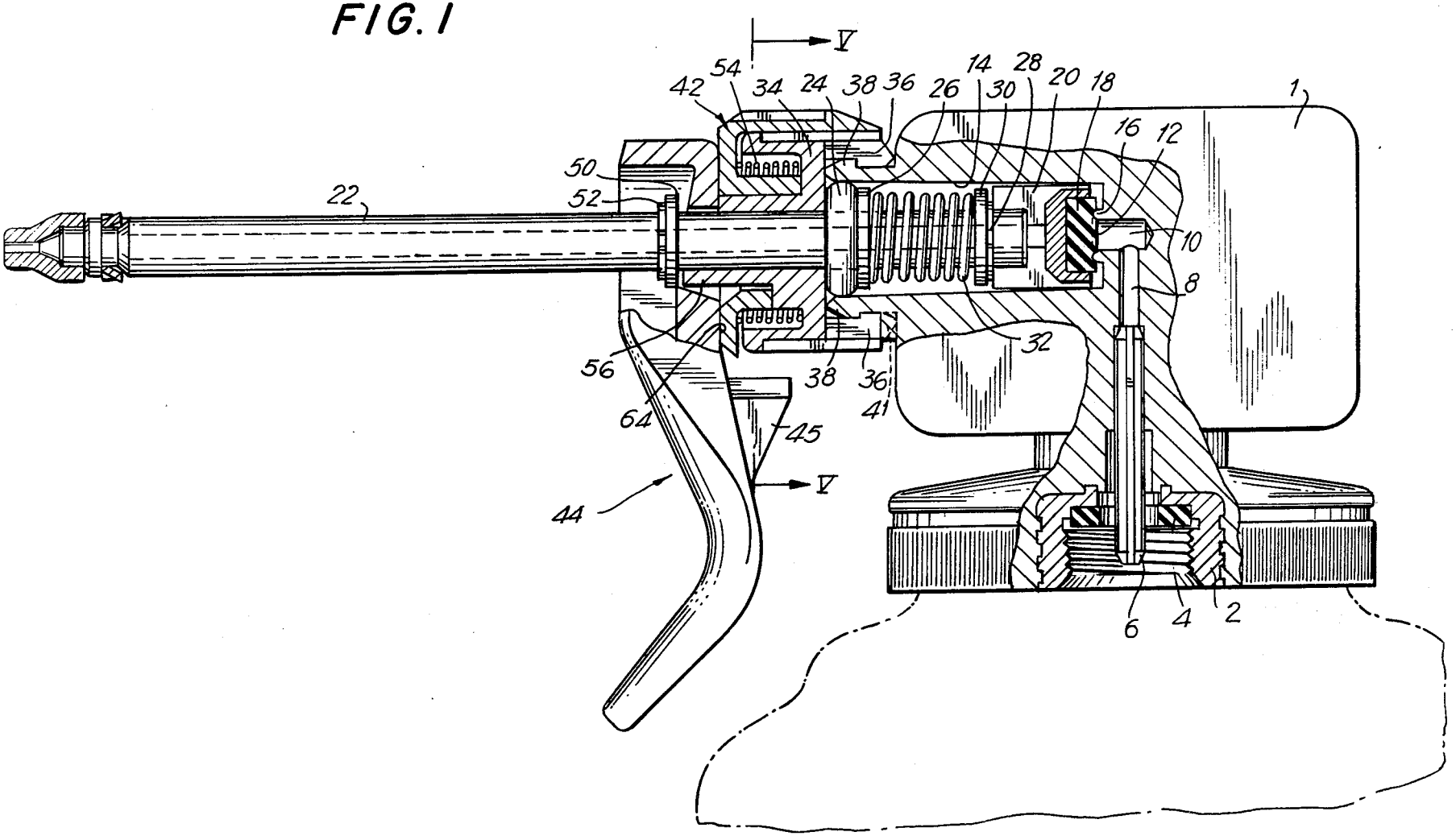
FIG. 1 is a side view, partially cut away, showing the control valve of the invention.

In the drawing, there is shown a valve body 1, the lower portion of which has a threaded collar 2. Collar 2 is designed to be attached to an aerosol can, for example, a canister of liquid flurocarbon such as freon, which is provided with a threaded fitting and a pin actuated canister valve, (not shown). A collar seal 4 is positioned in the collar 2 to provide a hermetic seal. The valve body has an opening 8 extending upward from the collar, and in which is positioned a hollow slotted roll pin 6. The pin is centered on the threaded collar 2 and has one end extending below the hole so as to engage and open the valve in the canister (not shown) when the control valve of FIG. 1 is attached to the canister. A axial opening through at the end of the and/or the slot in the side of roll pin or both permits the passage of flurocarbon gas from the canister therethrough and to the upper end of the opening 8 to a transverse or horizontal cylindrically shaped opening 10 in the body, which is open at a forward end 12.

Figure 2:
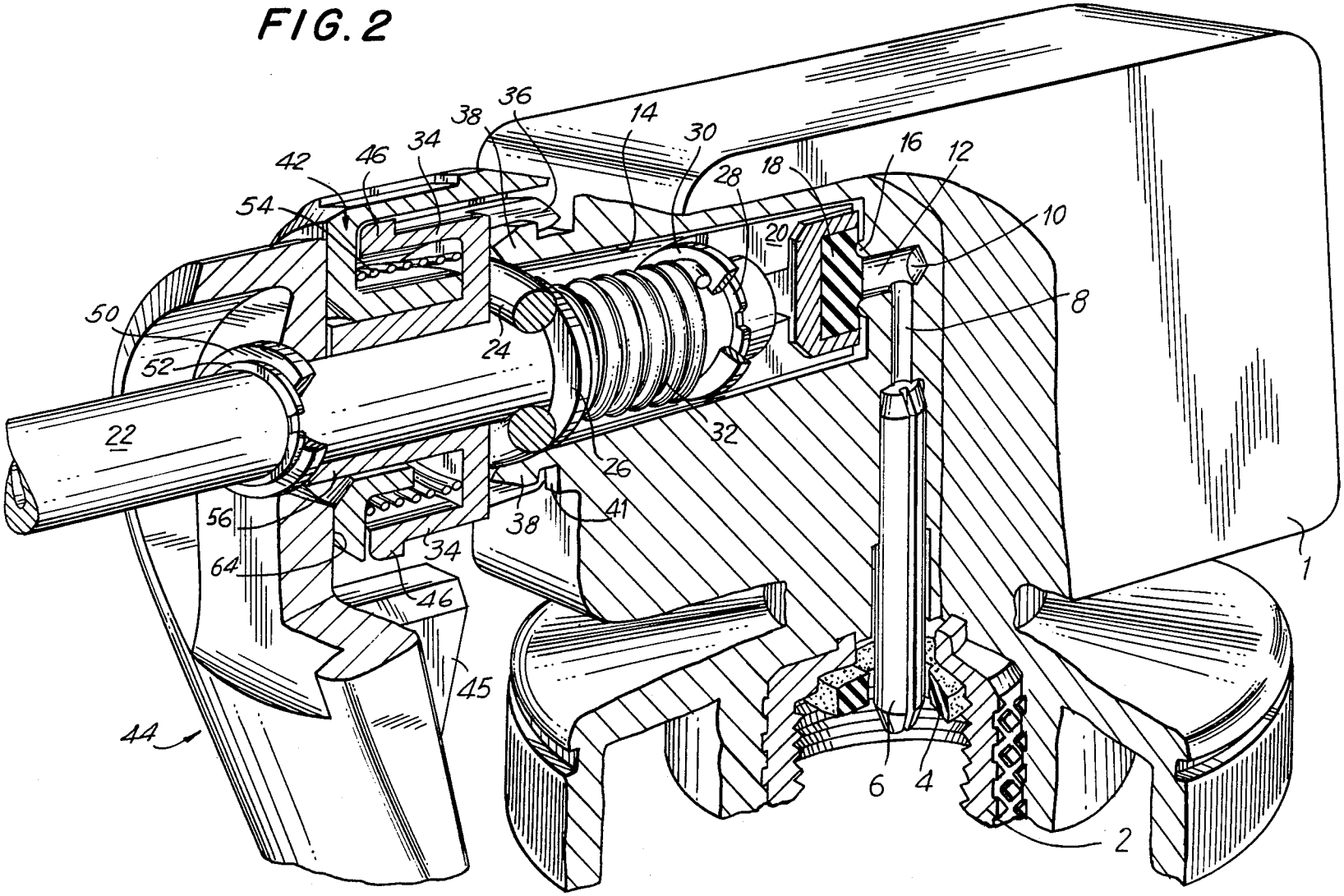
FIG. 2 is a isometric view, partially cut away, of the valve of FIG. 1.

The opening 12 communicates with a larger cylindrical area area 14 in the housing and which contains a spring and valve assembly. At the rear face of the larger opening 14 there is extending into the larger opening a valve seat 16. This valve seat can be seen clearly in the exploded view of FIG. 4, and as well as in FIGS. 1 and 2.

A movable valve seal or washer 18 in the normal or OFF position is pressed against the valve seat 16 and forms a seal, or complete closure, of the smaller opening. A valve seal holder 20 is positioned in the opening forward from the washer 18, and carries the washer 18.

Figure 4:
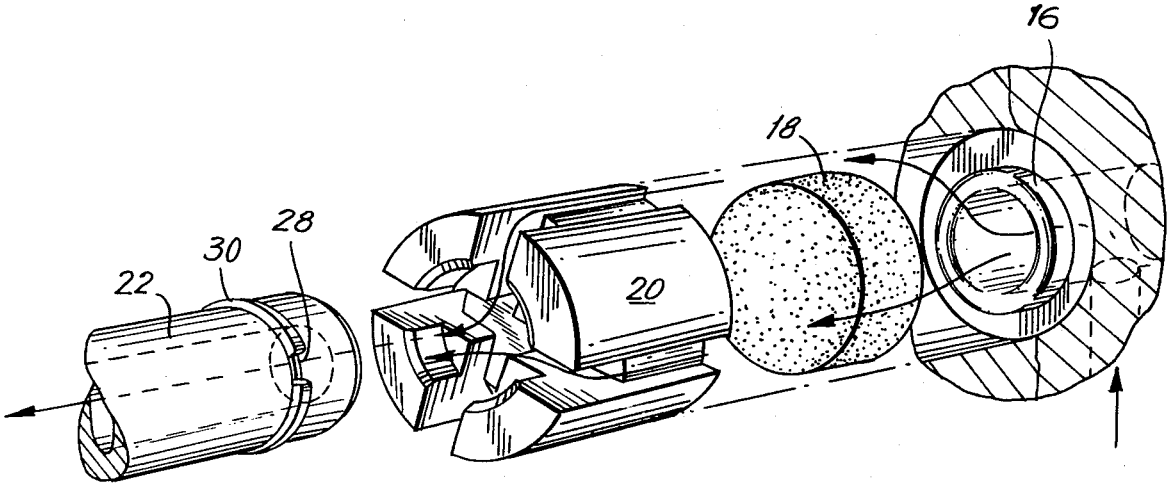
FIG. 4 is a detailed exploded view, showing one end of the barrel, the valve seal holder, the stem seal washer, and a portion of the housing of FIG. 1, illustrating the flow of gas around the seal holder.

A long hollow barrel 22 is positioned with one of its ends inside the opening 14 and extends leftward and forward from the opening 14 and the body 1. The barrel has a smaller outside diameter than the holder 20 and its end fits loosely in a recess in the holder. The barrel acts as a valve stem for the holder 20 and washer 18. Space between the washer 18 and the inside of the opening 14, and longitudinal channels in the side communicate with radial channels at the front of the holder 20 (as shown in FIG. 4) to permit the flow of gas from the opening 10, to the hollow bore of the barrel when the barrel moves forward i.e. when the valve is activated.

The opening 14 is sealed at its open left end by the barrel and an O-ring 24, which surrounds the barrel. Just inside of the O-ring is a washer 26.

Slightly forward from the right-most end of the barrel 22 and a sufficient distance so as not to interfere with the end of the barrel with the holder 20, there is a groove cut into the outer peripheral of the barrel and in which is mounted a protruding retaining ring 28. A ring support or washer 30 is mounted on the barrel adjacent to ring 28.

A valve spring 32 is mounted around the barrel between the two washers 26 and 30, exerting a force outwardly against the two washers. The spring urges the barrel to the right in the figures, pressing the end of the barrel against the holder 20 which in turn pushes the seal or washer 18 against the seat 16. The spring 32 is under sufficient compression in the normal condition to overcome any force from the pressure of gas coming from the canister through the roll pin and to the cylindrical opening 10.

When the valve is activated, the barrel is pulled forward (or leftward in the figures) compressing the spring and removing the pressure of the spring against the holder 20. Gas from the opening 10 travels past the seat, and around the washer 18 and through channels cut in the side of the holder 20, and into the hollow opening of the barrel and therethrough. This is shown in detail in the exploded view of FIG. 4.

The O-ring 24, is held in place by a hollow cylindrical barrel retainer 34 which is co-axial with and surrounds a portion of the barrel. It is mounted onto the front end of the body 1 shown in perspective in FIG. 3. The retainer is equipped with six flexible fingers 36 which snap over a flange 38 provided on the valve body 1. This secures the barrel retainer 34 to the body 1 and also secures the O-ring in place. The retainer is also provided with a slot 40 which engages a lug 41 on the valve body to prevent rotation of the retainer.

The barrel retainer serves several functions in the control valve. One of them just described, is to hold the valve assembly and the O-ring in place others are described later in this description.

A cylindrical control knob, or trigger lock 42 is mounted on and rotates about the barrel retainer 34. The lock can be rotated to three positions: (a) an ON position in which an operator-operative trigger 44 is pivoted to move forward the barrel 22; (b) a LOCK-OFF position in which the trigger is immobile (and the barrel remains in normal position due to spring 32; and (c) a LOCK-ON position in which the barrel is moved and held in a forward position and gas flows from the container past the valve seal and through the valve continuously without operation of the trigger. These three positions and the operation of the valve in each, are illustrated schematically in FIGS. 6, 7, and 8. FIGS. 1, 2, 3, and 5 all show the trigger lock in the ON position, and with the trigger at rest; this can be contrasted with FIG. 6, which shows the lock in the ON position, but with the trigger activated.

Figure 3:
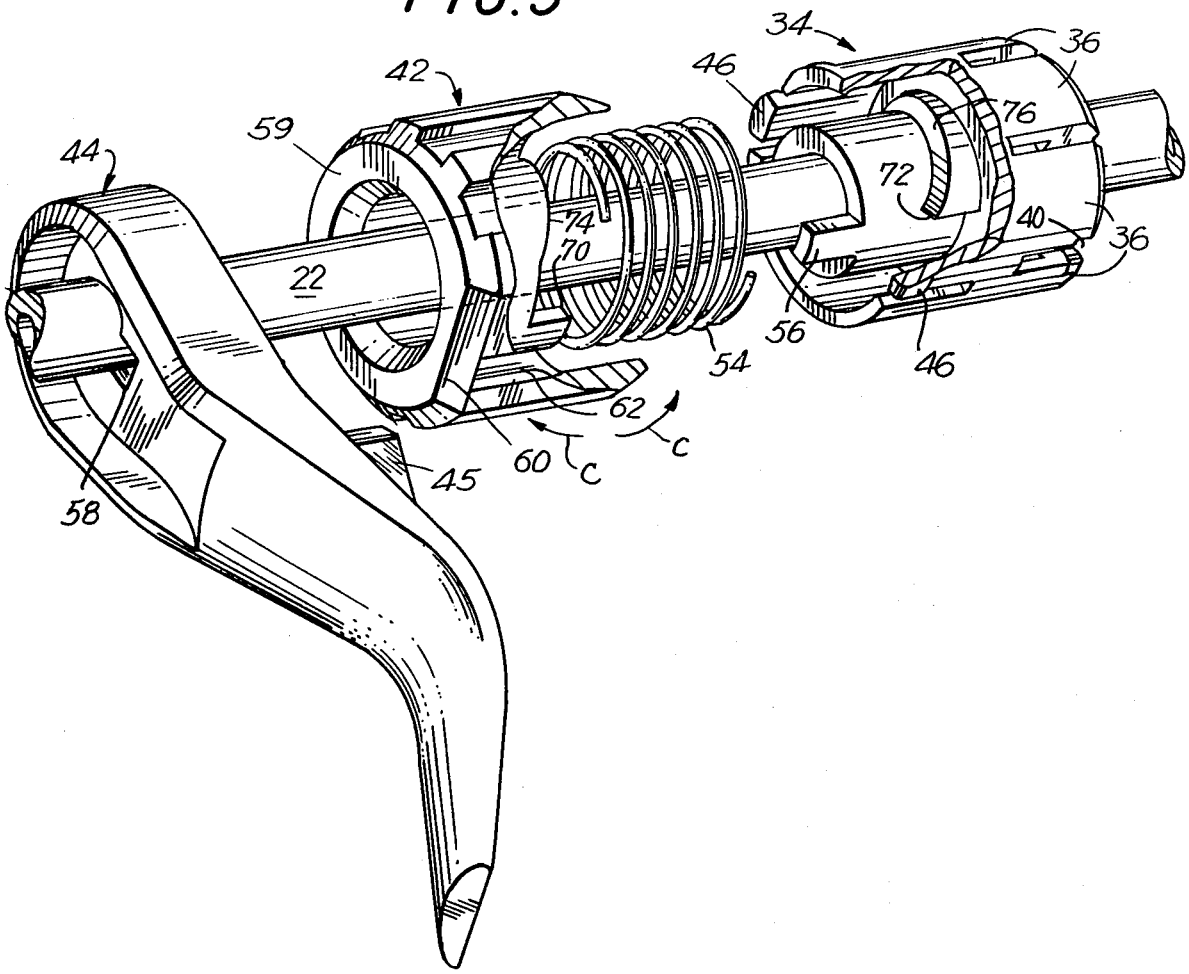
FIG. 3 is a detailed exploded view, showing a portion of the control valve, viz. trigger, trigger lock, trigger spring, and barrel retainer of FIG. 1; as viewed from the lower right.

The barrel retainer 34 has two opposing detent fingers 46 incorporated on its outer forward circumference. These are best seen in FIGS. 1, 3, and 5. In a relaxed state fingers 46 rest in one of three positions in slots 48, provided on the inside diameter of the trigger lock 42. Upon rotation of the trigger lock, these detent fingers are flexed inwardly towards the axis by means of ramp surface on the slots; and the detent fingers remain so flexed until another pair of slots in the trigger lock align with the fingers, which then permits the fingers to drop back into the relaxed state, and hold the lock in that position.

The barrel retainer 34 and trigger lock 42 each have internal cam surfaces which in the LOCK-ON position cooperate and this is described below.

Trigger 44 is mounted forward of the trigger lock, and its upper end straddles the barrel 22 with the barrel passing through a hole in the trigger. The trigger has a finger 45 which extends rearward to make contact with a front face of the trigger lock. The trigger is restrained from axial movement, relative to the barrel, by a washer 50 and a retaining ring 52 mounted in a groove on the barrel. The groove is just forward from the position of where the barrel passes through the hole in the trigger.

The washer 50 and retaining ring 52 are positioned so that the trigger at rest does not prevent the valve seal or washer 18 from seating properly in a closed position. The washer 50 and retaining ring 52 are of sufficient size and strength to make contact with the trigger; and when the trigger is actuated it pushes against the washer 50 and moves the barrel forward. In practical construction, this requires that the trigger have some small play between the washer-retaining ring 50–52 and the trigger lock 42; and the space is taken up by a light compression trigger-spring 54 that is mounted between the trigger lock 42 and barrel retainer 34 urging the lock 42 forward against the trigger. This prevents the trigger from wobbling, and the adjacent parts being loose.

To prevent unwanted rotation of the trigger about the barrel, a finger 56 on the barrel retainer 34 extends forward from the barrel retainer and engages a slot 58 in the trigger hole.

The operation of the control valve is as follows (with particular attention being directed to the trigger barrel retainer and trigger lock).

When the trigger lock is in the ON position, (FIGS. 1, 2, 3, 5 and 6), it presents to the trigger a flat annular surface 59 at its forward face; a second flat surface 60 extending from its lower perimeter rearward and downward and; an open slot 62 extending and centered on the lower surface. When the trigger is actuated, a flat surface 64 on the rear of the trigger 44 pivots on the leading edge of the adjacent surfaces 59 and 60 and the trigger finger 45 (pivoting back with trigger 44) passes through the slot 62 in the trigger lock. Thus the slot 62 does not prevent the trigger to be pivoted. This activation of the trigger causes the upper portion of the trigger to pivot forward, pressing against the washer 50 and retaining ring 52 on the barrel, and pulls the barrel forward, compressing the valve spring 32 and releasing the spring pressure on the valve seal holder 20 and valve seal 18, thus permitting gas to flow past the valve seal and holder and into the barrel opening. Release of the trigger permits the valve spring 32 to return the barrel, and the trigger, and the valve seal against the valve seat stopping the flow of gas.

The control valve can be placed in a LOCK-OFF, or inoperative position. This can best be seen in FIGS. 3 and 7. The trigger lock 42 is rotated in a counterclockwise direction (C—C as shown in FIG. 3). This causes an unslotted portion of the outer surface of the trigger to be positioned directly over the finger 45 of the trigger. Thus, if the trigger is attempted to be actuated, the finger 45 butts against the outer surface and remains inoperative. It will be noted that this is important when the control valve attached to a container is accidently knocked over, or packed for example in a repairman's tool kit. The degree of rotation, as shown in FIG. 5, is determined by the detent fingers 46 on the barrel retainer falling in the appropriate slots 48 cut in the trigger lock. Additional, as shown in FIG. 3, an inner surface 70 extending axially on the trigger lock 42 comes against an inner axial surface 72 on the barrel retainer 34. In an alternative embodiment, either one of these locking mechanisms (46, 48) or the surfaces (70, 72) may be used.

The control valve may be locked in a continuous LOCK-ON position. This is best seen in FIGS. 3 and 8, where there is shown cam surfaces 74 and 76 on the inside of the outer walls of the trigger lock 42 and barrel retainer 34. When the trigger lock 42 is rotated in the clockwise direction C, surface 74 is cammed forward by cam surface 76. These two opposing internal ramps or cams force the trigger lock 42 to move forward, which in turn forces the trigger 44 axially forward. This engages the washer 50 and retaining ring 52 on the barrel and forces the barrel forward, thus compressing the spring 32 releasing the valve holder 20 and seal 18, and permitting the flow of gas at 16, 18 and through the valve assembly to the hollow barrel. The valve remains open so long as the trigger lock remains in this clockwise rotated position; and until the barrel is rotated in the opposite, i.e. clockwise direction.

In both of the lock positions, whether LOCK-ON or LOCK-OFF, the slots 48 and detent fingers 46 define the rotation. The clockwise rotation is about 150° for caming LOCK-ON and the counterclockwise rotation is about 30° for LOCK-OFF. Alternatively, the slots and fingers for one or both of the lock positions may be omitted.

At the end of the barrel, there is a nozzle 78 with the desired orifice to provide the desired form of a spray or mist. The nozzle snaps onto and is retained in a groove 80 at the end of the nozzle.

The valve body 1 which attaches to the container at the collar 2 may contain a skirt 82.

It will be appreciated that the control valve as shown in the accompanying figure achieves the goals of a control valve for an aerosol can where the actuation may be either locked off, manually operable, or continuously operable. The delivery of the gas through a nozzle at the end of the barrel can be highly directional and remote from the hand of the operator. The barrel and nozzle permit the emitting gas to be accurately directed and positioned. The undesirable chilling effect on the operator is substantially avoided. The valve may be reusable and attached to additional containers of fresh gas.

It will be appreciated that various modifications may be made without departing from the scope and spirit of the present invention.

We claim:

1. A detachable control valve for an aerosol can comprising (a) a housing;

(b) a collar on said housing for being attached to a valve assembly on said aerosol can, and actuating said can valve when attached;

(c) a hollow barrel axially slideably mounted on said housing with one end inside and the other end outside said housing and having a normal position furthest into said housing and an activated position axially outward therefrom, said barrel having a first engaging member thereon just outside of said housing;

(d) a chamber in said housing communicating with said collar for receiving gas from said aerosol can when attached, and containing said one end of said barrel;

(e) an elongated trigger having an opening at one end and extending substantially perpendicular to said barrel, said trigger being positioned on said barrel between said barrel first engaging member and said housing with the barrel passing through said opening, said opening being slightly larger than the outside of the barrel to permit pivoting of said handle against said adjacent housing;

(f) a movable seal in said chamber normally closing one end of said communication with said collar;

(g) a spring in said chamber urging said seal and barrel into their normal position, whereby when said trigger is activated by an operator moving its other end, the trigger pivots against said adjacent housing with its one end engaging said barrel member, axially moving said barrel from its normal position against the force of the spring and thus opening the seal and establishing a path for gas from the aerosol can to flow to the chamber and then through the hollow in the barrel and out through the other end thereof; and wherein said housing includes adjacent said trigger a rotatable collar coaxial with said barrel and with an edge adjacent to said trigger, providing a pivot fulcrum for said trigger when the collar is rotated to a first position with the edge adjacent said trigger; a slot in said collar extending from said fulcrum edge into said housing; said trigger further comprising an extending finger between said other end and close to said pivot point, said finger enters said slot when the trigger is activated; said collar further comprising adjacent to said slot an outer surface, which when the collar is rotated to a second position the surface is adjacent the trigger finger, whereby in said second position said surface prevents actuation of the trigger.

2. A valve according to claim 1 wherein said rotatable collar has an annular face adjacent said trigger; said rotatable collar and said housing have adjacent faces with a cam thereon for cammed displacement of the collar in a plane parallel to the barrel axis; with rotation of said collar to a third position camming said collar toward said other end of said barrel, whereby rotation of said cam to said third position cams forward the collar moving said trigger against said barrel engaging member and said barrel outward to its activated position.

3. A valve according to claim 2 wherein said cam has two curved faces coaxial with the barrel axis, and the camming faces perpendicular to the axis, and extending not more than 150°.

4. A valve according to claim 1 or 2 wherein said housing and rotatable collar comprise slots and resilient detent fingers positioned for mutual engagement at at least one of said collar positions.

5. A valve according to claim 1 wherein said moveable valve seal includes a washer and a washer holder coaxial with and adjacent said one end of said barrel; said washer holder having channels therein for the passage of gas from said washer to said hollow in said barrel.

6. A valve according to claim 5 wherein said chamber is sealed by an O-ring surrounding said barrel and secured in the housing.

7. A valve according to claim 6 wherein said barrel has a second engaging member located inside said chamber, and said valve spring is mounted between said second engaging member and said O-ring.

8. A valve according to claim 5 wherein said housing includes a cylindrical retainer positioned adjacent said O-ring outside said chamber, and between said rotatable collar and said O-ring; and including a plurality of axially extending detented fingers for engaging an annular flange on said housing.

9. A valve according to claim 1 wherein said trigger includes a slot at one end of said trigger opening and said housing includes a finger projecting along the trigger extending into said slot for preventing rotation of said trigger.

* * * * *

UNITED STATES PATENT AND TRADEMARK OFFICE

CERTIFICATE OF CORRECTION

PATENT NO. : 4,453,650

DATED : June 12, 1984

INVENTOR(S) : Paul A. Witte and Michael J. Pappas

It is certified that error appears in the above-identified patent and that said Letters Patent is hereby corrected as shown below:

Page 1, List of U.S. Patent Documents:

Col. 2, line 2, change "Gartler" to --Gurtler--.

Col. 2, line 46, change "A" to --An--.

Col. 2, line 47, change "of the and/or" to --on--.

Col. 2, line 54, delete "area" (second occurrence).

Col. 5, line 13, "additional" should be --Additionally--.

Signed and Sealed this

*First* Day of *January 1985*

[SEAL]

*Attest:*

GERALD J. MOSSINGHOFF

*Attesting Officer*

*Commissioner of Patents and Trademarks*